US011065679B2

(12) United States Patent
Yi et al.

(10) Patent No.: US 11,065,679 B2
(45) Date of Patent: Jul. 20, 2021

(54) VACUUM SYSTEM FOR DIE CASTING MOLD

(71) Applicants: Hyundai Motor Company, Seoul (KR); Kia Motors Corporation, Seoul (KR)

(72) Inventors: Hae-Ryong Yi, Gyeonggi-do (KR); Sang Min Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/983,106

(22) Filed: Aug. 3, 2020

(65) Prior Publication Data

US 2021/0138536 A1 May 13, 2021

(30) Foreign Application Priority Data

Nov. 13, 2019 (KR) ..... 10-2019-0145306

(51) Int. Cl.

| | |
|---|---|
| ***B22D 17/14*** | (2006.01) |
| ***B22C 9/06*** | (2006.01) |
| ***B22C 9/08*** | (2006.01) |
| ***B22D 18/06*** | (2006.01) |

(52) U.S. Cl.

CPC ..... *B22D 17/145* (2013.01); *B22C 9/067* (2013.01); *B22C 9/082* (2013.01); *B22D 17/14* (2013.01); *B22D 18/06* (2013.01)

(58) Field of Classification Search

CPC ..... B22D 17/14; B22D 17/145; B22C 9/067

See application file for complete search history.

(56) References Cited

U.S. PATENT DOCUMENTS

| | | | | |
|---|---|---|---|---|
| 8,424,587 | B1 * | 4/2013 | Dubay | B29C 45/34 164/305 |
| 2014/0196864 | A1 * | 7/2014 | Werner | B22C 9/067 164/410 |

FOREIGN PATENT DOCUMENTS

| | | | |
|---|---|---|---|
| JP | 2005-152924 | A | 6/2005 |
| JP | 2008080391 | A * | 4/2008 |
| JP | 2009045630 | A * | 3/2009 |
| JP | 2014091163 | A * | 5/2014 |
| KR | 101594094 | B1 | 2/2016 |
| KR | 2018-0006772 | A | 1/2018 |

* cited by examiner

*Primary Examiner* — Kevin E Yoon

(74) *Attorney, Agent, or Firm* — Mintz Levin Cohn Ferris Glovsky and Popeo, P.C.; Peter F. Corless

(57) ABSTRACT

A vacuum system for a die casting mold, which forms vacuum inside a cavity formed between a fixed mold and a movable mold, includes: a ventilation assembly disposed between the cavity and a vacuum pump and mounted between the fixed mold and the movable mold and configured to decrease a flow rate of molten metal when the molten metal filled in the cavity flows in; and a vacuum pump forming the vacuum inside the ventilation assembly.

17 Claims, 8 Drawing Sheets

VACUUM SYSTEM FOR DIE CASTING MOLD

CROSS-REFERENCE TO RELATED APPLICATION

This application claims under 35 U.S.C. § 119 the benefit of Korean Patent Application No. 10-2019-0145306 filed in the Korean Intellectual Property Office on Nov. 13, 2019, the entire contents of which are incorporated herein by reference.

BACKGROUND

(a) Technical Field

The present disclosure relates to a vacuum system for a die casting mold, more particularly, to the vacuum system capable of forming a vacuum inside a cavity formed between a fixed mold and a movable mold during a casting operation.

(b) Description of the Related Art

Die casting is a precision casting method that obtains the same casting as a mold by injecting molten metal into a forced mold precisely machined so as to completely match a required casting shape, and a resulting product is referred to as a die cast.

A method of die casting is characterized by excellent mechanical properties and mass production in addition to an advantage of almost no need for finishing because a size of the cast is accurate.

Metal used for the method includes an alloy of zinc, aluminum, tin, copper, magnesium, etc., and the product is cast by cooling and solidifying the metal by injecting the metal by air pressure, water pressure, or hydraulic pressure using a die cast casting machine.

In the die casting method, after a fixed mold and a movable mold are combined, the molten metal is filled on a sleeve connected to a cavity between the fixed mold and the movable mold through a ladle.

In the die casting method, a large portion of the molten metal contacts air and gas in the cavity due to an injection effect of a gate during high-speed casting, and residual gas in the sleeve and gas which is not exhausted to the outside of the mold influence a quality of the product.

Accordingly, in the die casting method, the air and gas inside the cavity are more actively forcibly exhausted using a vacuum device, thereby enhancing product quality and minimizing bubbles, unmolding, shrinkage, and the like.

In other words, a structure is formed, in which when filling the molten metal in the cavity is completed and then the molten metal reaches the vacuum device which is a final filling unit of the mold, a valve of the vacuum device is closed due to a physical collision of the molten metal and the molten metal is prevented from flowing into a vacuum tank.

However, in a conventional die casting vacuum device, when high-temperature and high-speed molten metal reaches the final filling unit, the molten metal flows into a gas vent and a vacuum facility and is solidified due to a high speed.

This inhibits gas inhalation of the vacuum device and can enhance a defect rate of the product in subsequent production.

Further, the conventional die casting vacuum device has a problem in that an operation rate of a factory is impaired due to component damage or malfunction due to physical collisions by the high speed molten metal at the time of producing the product.

The above information disclosed in this Background section is only for enhancement of understanding of the background of the disclosure, and therefore it may contain information that does not form the prior art that is already known in this country to a person of ordinary skill in the art.

SUMMARY

The present disclosure provides a vacuum system for a die casting mold capable of reducing a damage risk and enhancing durability by applying a ventilation assembly so as to prevent a molten metal filling a cavity of a fixed mold and a movable mold from reaching a vacuum pump during casting.

An exemplary embodiment of the present disclosure provides a vacuum system for a die casting mold, which forms vacuum inside a cavity formed between a fixed mold and a movable mold, the vacuum system including: a ventilation assembly disposed between the cavity and a vacuum pump and mounted between the fixed mold and the movable mold and configured to decrease a flow rate of molten metal when the molten metal filled in the cavity flows in; and a vacuum pump forming the vacuum inside the ventilation assembly The ventilation assembly may include a first ventilation unit and a second ventilation unit mounted on the fixed mold and the movable mold, respectively, above the cavity, and the first ventilation unit and the second ventilation unit are in close contact with each other by combining the fixed mold and the movable mold to form a primary flow rate control section on a lower inner surface connected to the cavity and form a secondary flow rate control section connected to the primary flow rate control section on an upper inner surface.

In the ventilation assembly, an inlet through which the molten metal moves to the primary flow rate control section in connection with the cavity may be formed at one side of a lower end and an outlet through which air moves in connection with the vacuum pump from the secondary flow rate control section may be formed at one side of an upper end.

The primary flow rate control section may include a first flow pattern having an entrance into which the molten metal flows and an exit from which the molten metal is discharged and including a chamber causing flow separation of the molten metal formed between the entrance and the exit.

An angle formed by surfaces facing each other, which are connected to the entrance of the first flow pattern may be in the range of 5 to 85°.

Heights of the entrance and the exit of the first flow pattern may be in the range of 5 to 15 mm.

Widths of the entrance and the exit of the first flow pattern may be in the range of 5 to 15 mm.

A curvature radius of the edge formed in the first flow pattern may be in the range of 0.5 to 5.0 mm.

A reflective curved surface may be formed adjacent to the exit of the first flow pattern, which returns the molten metal toward the entrance of the first flow pattern.

The secondary flow rate control section may include a second flow pattern having one end connected to the primary flow rate control section, an opposite end connected to the outlet, and having a predetermined shape.

In the second flow pattern, a width through which the molten metal passes may be in the range of 0.5 to 2 mm.

The second flow pattern may be symmetric in a multiple-step bending shape and a height between stepped ends may be in the range of 1 to 5 mm.

In the second flow pattern, the curvature radius of each edge may be in the range of 0.5 to 5.0 mm.

The ventilation assembly may include: a first body mounted on any one mold between the fixed mold and the movable mold, having a first seating surface formed on a lower inner surface contacting the molten metal, and having an upper guide end protruding stepwise from the first seating surface on an upper inner surface and a plurality of first grooves formed inside the upper guide end to be perpendicular to a flow direction of the molten metal; a first sub-body mounted on the first seating surface, having a lower guide end connected to the upper guide end, and having a plurality of first protrusions formed inside the lower guide end to be perpendicular to the flow direction of the molten metal; a second body mounted on the other mold of the fixed mold and the movable mold, having a second seating surface formed on a lower inner surface contacting the molten metal to correspond to the first seating surface, and having a plurality of second grooves formed to be perpendicular to the flow direction of the molten metal; a second sub-body mounted on the second seating surface and having a plurality of second protrusions formed to be perpendicular to the flow direction of the molten metal; and a cover coupled to tops of the first and second bodies and having a suction port which is in communication with the vacuum pump.

A molten metal groove into which the molten metal flows may be formed on the lower guide end of the first sub-body.

A position of the first sub-body may be regulated through a first key between the first sub-body and the first seating surface of the first body, and the position of the second sub-body may be regulated through a second key between the second sub-body and the second seating surface of the second body.

In the first protrusion and the second protrusion, a first flow pattern having an entrance into which the molten metal flows and an exit from which the molten metal is discharged and including a chamber for causing flow separation of the molten metal formed between the entrance and the exit may be formed.

The first groove and the second groove may form a second flow pattern symmetric in a multi-step bending shape.

According to an exemplary embodiment of the present disclosure, a vacuum system for a die casting mold can reduce a damage risk and enhance durability by applying a ventilation assembly so as to prevent a molten metal filling a cavity from reaching a vacuum pump while maintaining the cavity between a fixed mold and a movable mold in a vacuum state during casting.

In other words, in the vacuum system for the die casting mold, the molten metal hits a waveform of a unique pattern while passing through each of a primary flow rate control section and a secondary flow rate control section of the ventilation assembly, resulting in overall energy loss and at the same time, a resistance area is widened and the flow rate is reduced, and as a result, the molten metal can be stopped without reaching the vacuum pump.

Moreover, according to an exemplary embodiment of the present disclosure, in a vacuum system for a die casting mold, vacuum is formed inside the fixed mold and the movable mold effectively in a simple structure to enhance productivity and produce high-quality castings.

Besides, an effect which can be obtained or predicted by the exemplary embodiment of the present disclosure is directly or implicitly disclosed in detailed description of the exemplary embodiment of the present disclosure. That is, various effects predicted according to the exemplary embodiment of the present disclosure will be disclosed in the detailed description to be described below.

DETAILED DESCRIPTION OF THE EMBODIMENTS

Figure 1:
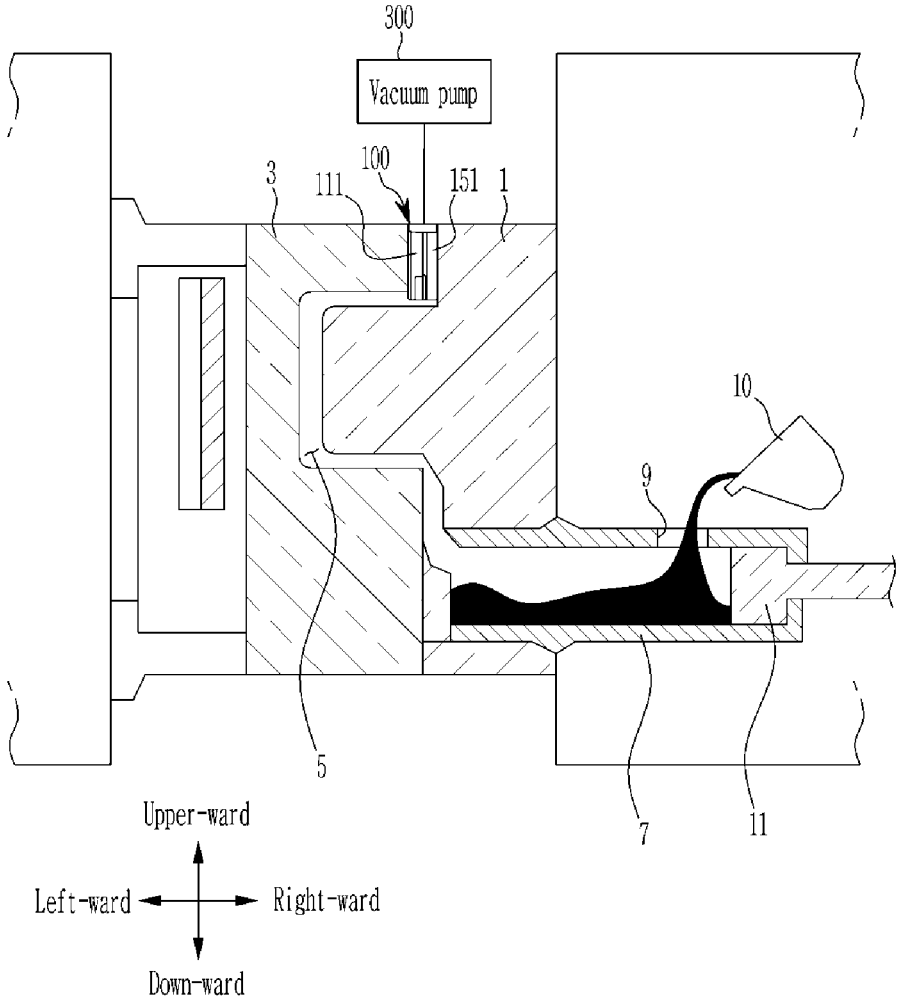
FIG. 1 is a cross-sectional view illustrating a vacuum system for a die casting mold according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

The drawings and description are to be regarded as illustrative in nature and not restrictive and like reference numerals designate like elements throughout the specification.

In the following description, dividing names of components into first, second, and the like is to divide the names because the names of the components are the same as each other, and an order thereof is not particularly limited.

FIG. 1 is a cross-sectional view illustrating a vacuum system for a die casting mold according to an exemplary embodiment of the present disclosure.

In describing the vacuum system for the die casting mold according to the exemplary embodiment of the present disclosure, the vacuum system for the die casting mold will be described by setting front-rear, left-right, and upper-down directions as a reference direction based on FIG. 1 for convenience of understanding.

The reference direction has a relative meaning, and since the direction may vary depending on a reference position of the system or a reference position of an assembly component, the reference direction is not particularly limited to the reference direction of the exemplary embodiment.

Referring to FIG. 1, the vacuum system for the die casting mold according to the exemplary embodiment of the present disclosure may be applied to a precisely machined casting device so as to completely or substantially match a required casting shape.

The mold includes a fixed mold 1 and a movable mold 3.

When the fixed mold 1 and the movable mold 3 are combined, a cavity 5 having a predetermined shape is formed on each of inner surfaces facing each other A sleeve 7 connected to the cavity 5 is mounted on one side of the fixed mold 1.

A through-hole 9 is formed at one side of the sleeve 7 and a molten metal contained in a ladle 10 flows into the sleeve 7 through the through-hole 9.

Further, a piston 11 is inserted into the sleeve 7 and the piston 11 may operate with a driving force of a hydraulic cylinder (not illustrated).

In other words, when the piston 11 inside the sleeve 7 is pressed by using force of the hydraulic cylinder, the molten metal in the sleeve 7 is filled in the cavity 5.

A high-pressure and vacuum state is maintained until solidification of the molten metal inside the cavity 5 is completed.

When air in the fixed mold 1 and the movable mold 3 combined before the molten metal is completely filled in the cavity 5 is completely discharged to the outside, bubble defects in the casting product may be prevented.

In this case, the vacuum system is applied to discharge the air in each mold, and the vacuum system includes a ventilation assembly 100 and a vacuum pump 300.

The ventilation assembly 100 is provided between the fixed mold 1 and the movable mold 3, and the ventilation assembly 100 is connected to the external vacuum pump 300 to maintain the inside of the cavity 5 in the vacuum state.

A configuration of the ventilation assembly 100 will be described below.

Figure 2:
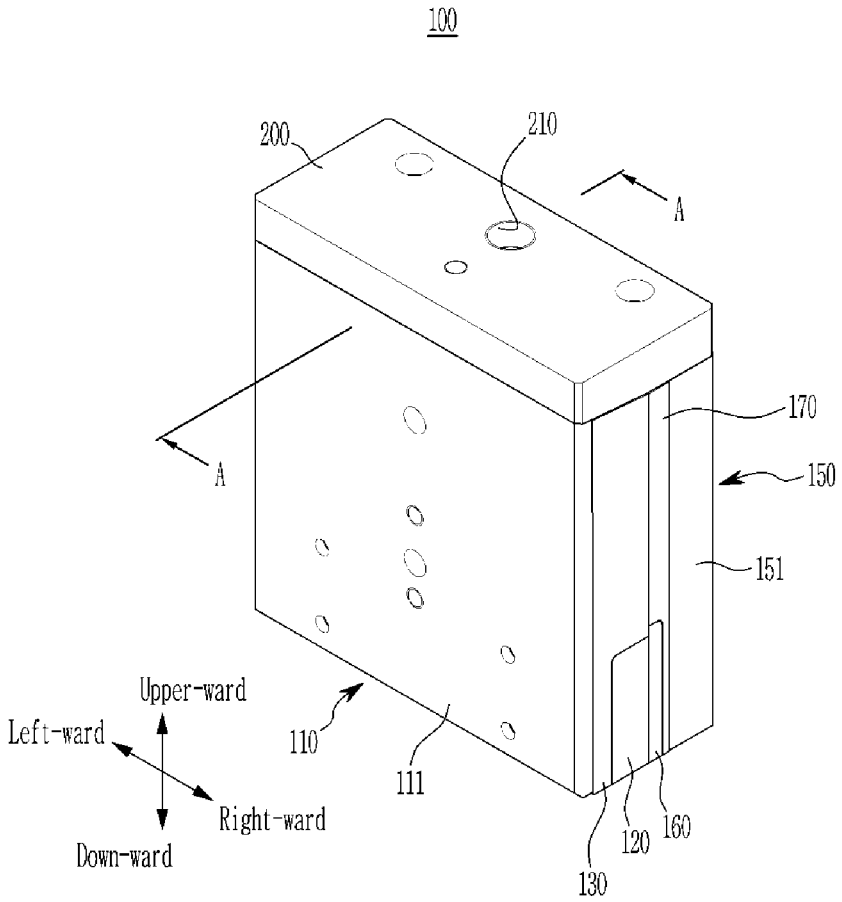
FIG. 2 is a perspective view of a ventilation assembly applied to a vacuum system for a die casting mold according to an exemplary embodiment of the present disclosure.
Figure 3:
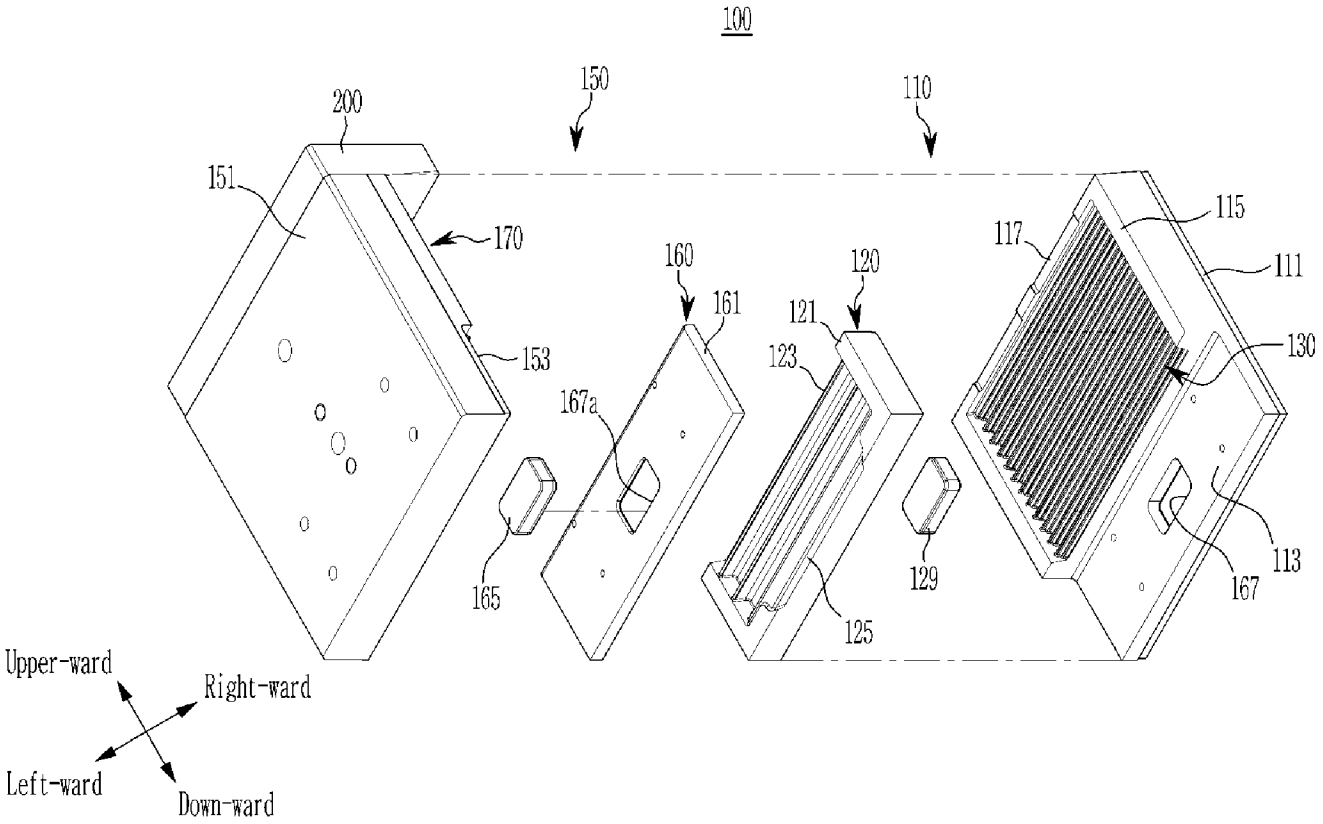
FIGS. 3 and 4 are exploded perspective views of one side and the other side of a ventilation assembly applied to a vacuum system for a die casting mold according to an exemplary embodiment of the present disclosure.
Figure 4:
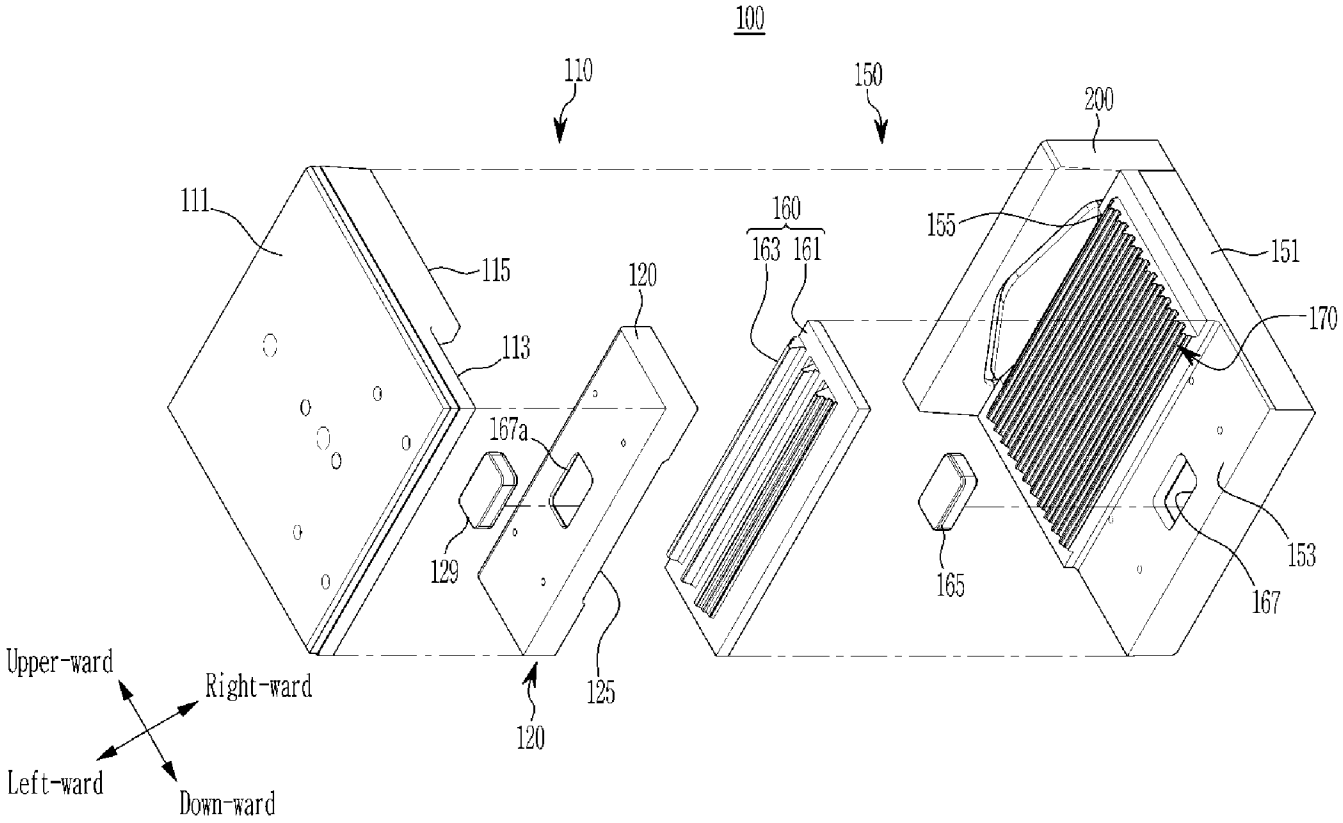
Figure 5:
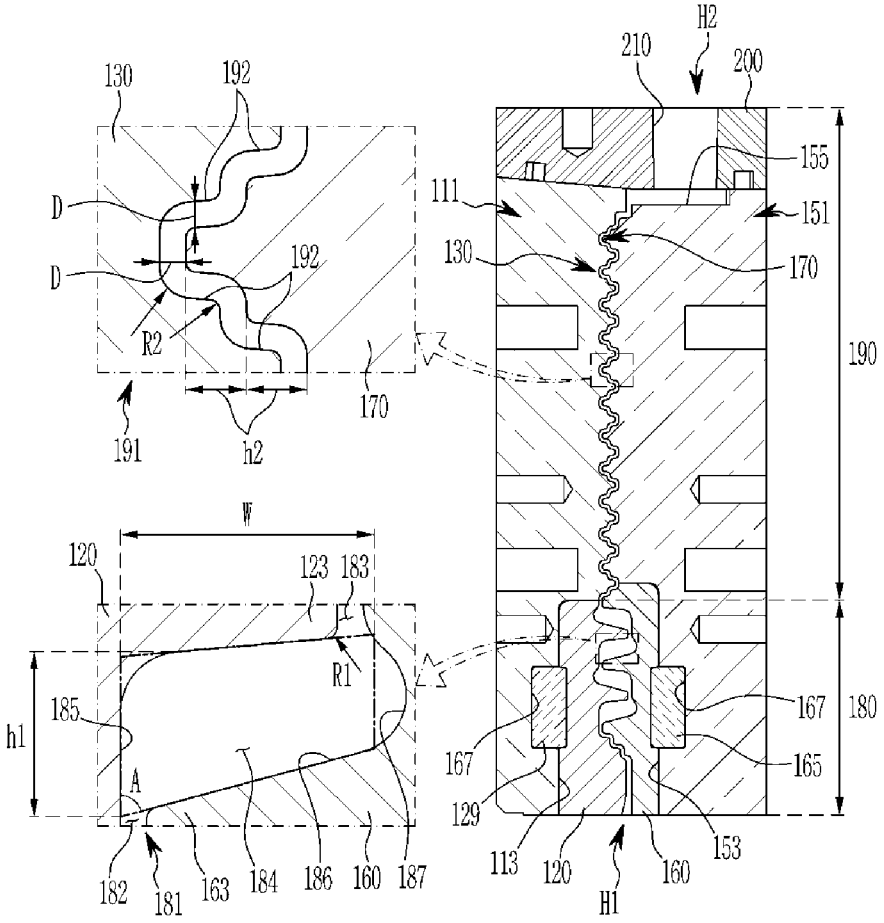
FIG. 5 is a cross-sectional view taken along line A-A of FIG. 2.

FIG. 2 is a perspective view of a ventilation assembly applied to a vacuum system for a die casting mold according to an exemplary embodiment of the present disclosure, FIGS. 3 and 4 are exploded perspective views of one side and the other side of a ventilation assembly applied to a vacuum system for a die casting mold according to an exemplary embodiment of the present disclosure, and FIG. 5 is a cross-sectional view taken along line A-A of FIG. 2.

Referring to FIGS. 2 to 5, the ventilation assembly 100 may include a first ventilation unit 110 and a second ventilation unit 150, and the first ventilation unit 110 and the second ventilation unit 150 may be selectively mounted on the fixed mold 1 and the movable mold 3, respectively.

For example, the first ventilation unit 110 may be mounted on the fixed mold 1 and the second ventilation unit 150 may be mounted on the movable mold 3, or alternatively, the first ventilation unit 110 may be mounted on the movable mold 3 and the second ventilation unit 150 may be mounted on the fixed mold 1.

The first ventilation unit 110 and the second ventilation unit 150 are in close contact with each other by a combination of the fixed mold 1 and the movable mold 3 to form a primary flow rate control section 180 and a secondary flow rate control section 190.

The primary flow rate control section 180 is connected to the cavity 5, and the secondary flow rate control section 190 is connected to the primary flow rate control section 180 and is disposed adjacent to the air pump.

The first ventilation unit 110 includes a first body 111, a second sub-body 120, and a first groove 130.

A first seating surface 1113 is formed on a lower inner surface contacting the molten metal in the first body 111.

Here, the inner surface of the first body 111 is a surface contacting a second body 151 and a surface through which the molten metal passes, and similarly, the inner surface of the second body 151 refers to a surface contacting the first body 111 and refers to the surface through which the molten metal passes.

Further, in the first body 111, an upper guide end 115 is protruded stepwise from the first seating surface 113 and formed along an edge of a predetermined section.

The upper guide end 115 may be formed on both surfaces and an upper surface above the inner surface of the first body 111.

A first air groove 117 into which the air is suctioned by the vacuum pump 300 is formed on the upper surface of the upper guide end 115.

In addition, the first sub-body 120 is mounted on the first seating surface 113.

A lower guide end 121 connected to the upper guide end 115 is formed in the first sub-body 120.

In other words, the lower guide end 121 is formed on both surfaces and the lower surface on the inner surface of the first sub-body 120.

A plurality of first protrusions 123 is formed to be perpendicular to a flow direction of the molten metal inside the lower guide end 121 in the first sub-body 120.

A molten metal groove 125 into which the molten metal flows is formed below the lower guide end 121.

The molten metal groove 125 serves as an inlet H1 through which the molten metal flows into the ventilation assembly 100 when the fixed mold 1 and the movable mold 3 are combined with each other.

The first sub-body 120 may be bolt-fastened to the first body 111 in a state in which a position is regulated through a first key 129 between the first sub-body 120 and the first seating surface 113 of the first body 111.

The first key 129 may be formed in a block shape and may fit into each of a fitting groove 167 formed on the first seating surface 113 and a fitting groove 167*a* formed in the first sub-body 120.

In addition, the first groove 130 is formed inside the upper guide end 115 of the first body 111.

The first groove 130 may be disposed to be perpendicular to the flow direction of the molten metal similarly to the first protrusion 123 of the first sub-body 120.

The second ventilation unit 150 includes the second body 151, a second sub-body 160, and a second groove 170.

A second seating surface 153 is formed on a lower inner surface contacting with the molten metal to correspond to the first seating surface 113 in the second body 151

Further, a second air groove 155 is formed on the upper inner surface of the second body 151 to correspond to the first air groove 117, and in the second air groove 155, an outlet H2 through which the air moves together with the first air groove 117 is formed.

The second sub-body 160 is mounted on the second seating surface 153.

The second sub-body 160 includes a plate 161 contacting the second seating surface 153 and a plurality of second protrusions 163 integrally formed on one surface of the plate 161.

The second protrusion 163 is protruded to be bent in a predetermined shape and the second sub-body 160 elongates in a vertical direction to a progress direction of the molten metal, and the second sub-body 160 is formed in a shape corresponding to the first protrusion 123 of the first sub-body 120.

The second sub-body 160 is coupled to the first sub-body 120 to form the primary flow rate control section 180.

Further, the second sub-body 160 may be bolt-fastened to the second body 151 in a state in which a position is regulated through a second key 165 between the second sub-body 120 and the second seating surface 153 of the second body 151.

The second key 165 may be formed in the block shape and may fit into each of the fitting groove 167 formed on the first seating surface 153 and the fitting groove 167*a* formed on the plate 161 of the first sub-body 120.

In addition, the second groove 170 is formed in a section corresponding to the first groove 130 in the second body 151.

The second groove 170 forms the secondary flow rate control section 190 together with the first groove 130.

The primary flow rate control section 180 and the secondary flow rate control section 190 formed as above have the following features.

The primary flow rate control section 180 includes a plurality of first flow patterns 181 formed by the first sub-body 120 and the second sub-body 160 coupled with each other.

The first flow pattern 181 may have an overall shape of a trapezoid.

An entrance 182 into which the molten metal flows and an exit 183 from which the molten metal is discharged are formed in the first flow pattern 181, and a chamber 184 for generating flow separation of the molten metal may be formed between the entrance 182 and the exit 183.

Further, an angle A formed by surfaces 185 and 186 facing each other, which are connected to the entrance 182 of the first flow pattern 181 may be in the range of 5 to 85°.

The angle A may be set within an angular range to form the trapezoid.

Heights h1 of the entrance 182 and the exit 183 of the first flow pattern 181 may be set in a range of 5 to 15 mm.

Here, the height is named as the height h1 of the first flow pattern 181, but the height h1 is defined based on the direction illustrated in the drawing and a name for the length may be changed.

Widths W of the entrance 182 and the exit 183 of the first flow pattern 181 may be set in the range of 5 to 15 mm.

Here, the width is named as the W of the first flow pattern 181, but the width W is defined based on the direction illustrated in the drawing and the name for the length may be changed.

Further, in the first flow pattern 181, a curvature radius R1 of each rounded edge may be set in a range of 0.5 to 5.0 mm.

A reflective curved surface 187 may be formed adjacent to the exit 183 of the first flow pattern 181, which returns the molten metal toward the entrance 182 of the first flow pattern 181.

As the first flow pattern 181, four flow patterns which are connected to be symmetric to each other are described as an example in the drawing, but the first flow pattern 181 is not particularly limited thereto and the number of first flow patterns may be changed and applied as necessary In other words, the numbers of first sub-bodies 120 and second sub-bodies 160 are changed to change and apply the number of first flow patterns 181.

Meanwhile, the secondary flow rate control section 190 may include a plurality of second flow patterns 191 formed by the first groove 130 and the second groove 170

One end of the second flow pattern 191 is connected to the primary flow rate control section 180 and an opposite end is connected to the outlet H2.

In the second flow pattern 191, a width D through which the molten metal passes may be set to 1 to 5 mm.

The second flow pattern 191 may be formed as a labyrinth in which a plurality of step portions 191 is repeated.

The second flow pattern 191 may be symmetric in a multi-step bending shape and a height h2 between stepped ends may be formed to be 1 to 5 mm.

Here, the height is named as the height h2 of the second flow pattern 191 is named, but the height h2 is defined based on the direction illustrated in the drawing and the name for the length may be changed.

Further, in the second flow pattern 191, a curvature radius R2 of each edge may be formed to be 0.5 to 5.0 mm.

As the second flow pattern 191, twelve flow patterns which are connected are described as an example in the drawing, but the second flow pattern 191 is not particularly limited thereto and the number of flow patterns may be changed and applied as necessary.

In other words, the numbers of first grooves 130 and second grooves 170 are changed to change and apply the number of second flow patterns 191.

A cover 200 is mounted on the tops of the first and second ventilation units 110 and 150.

A suction port 210 is formed in the cover 200 so that the air is suctioned from the vacuum pump 300.

Figure 6:
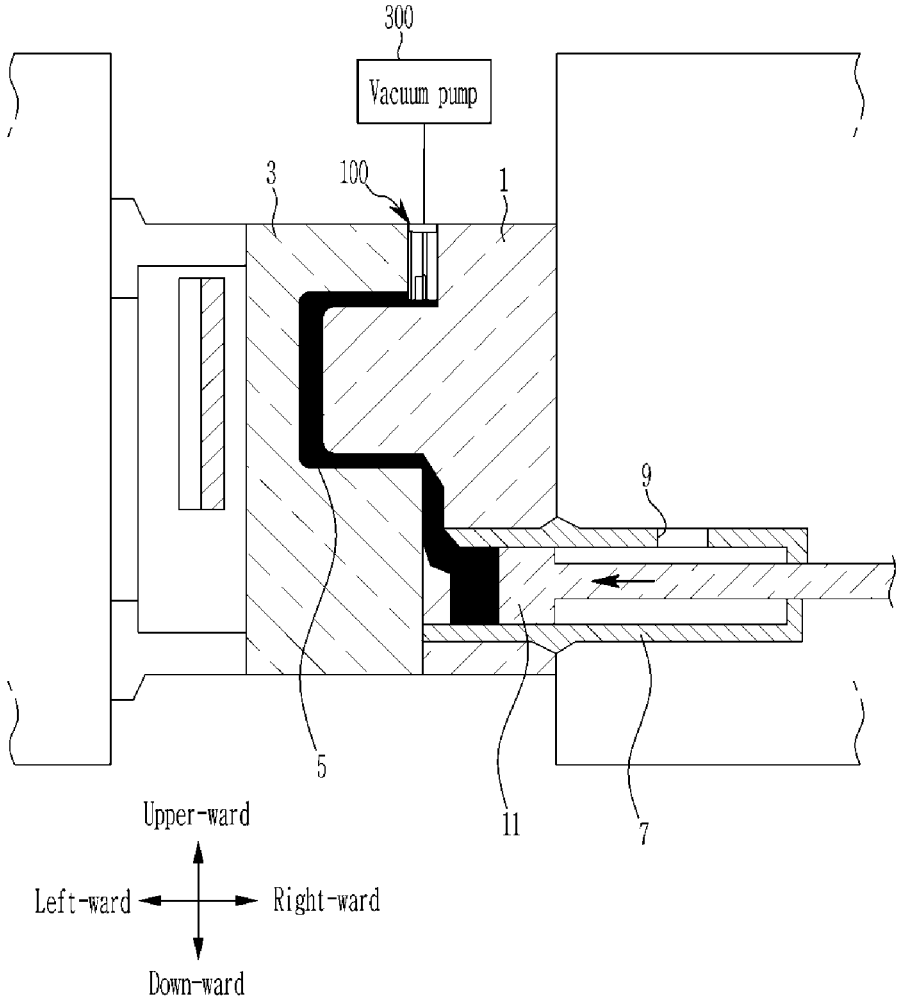
FIGS. 6 to 8 are diagrams illustrating an operation of a mold to which a vacuum system for a die casting mold is applied according to an exemplary embodiment of the present disclosure.
Figure 7:
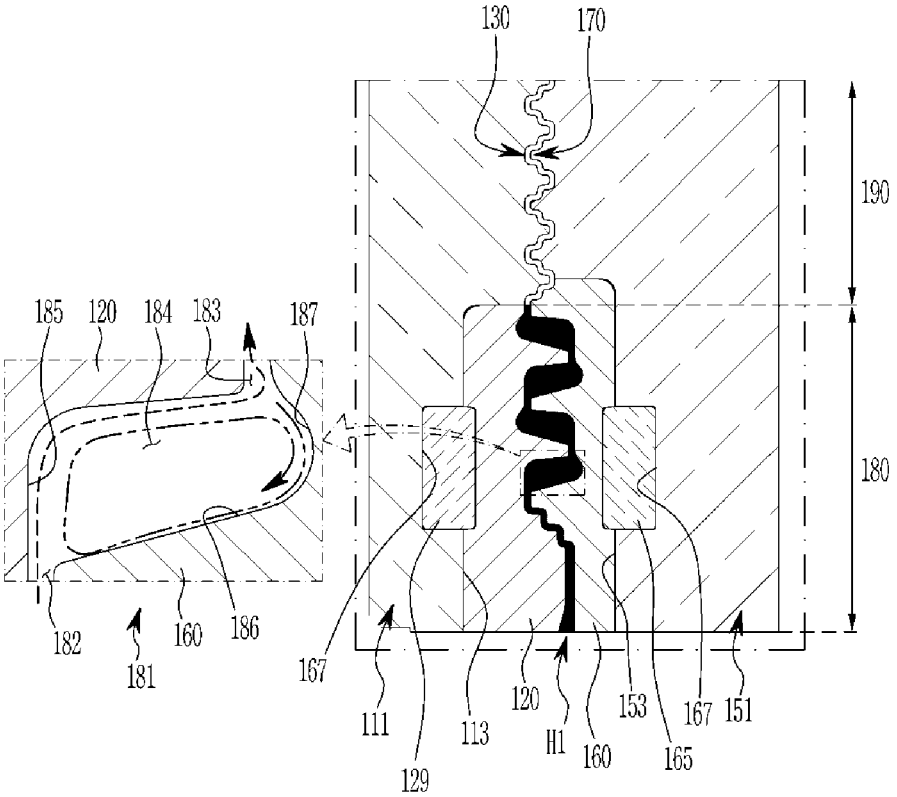
Figure 8:
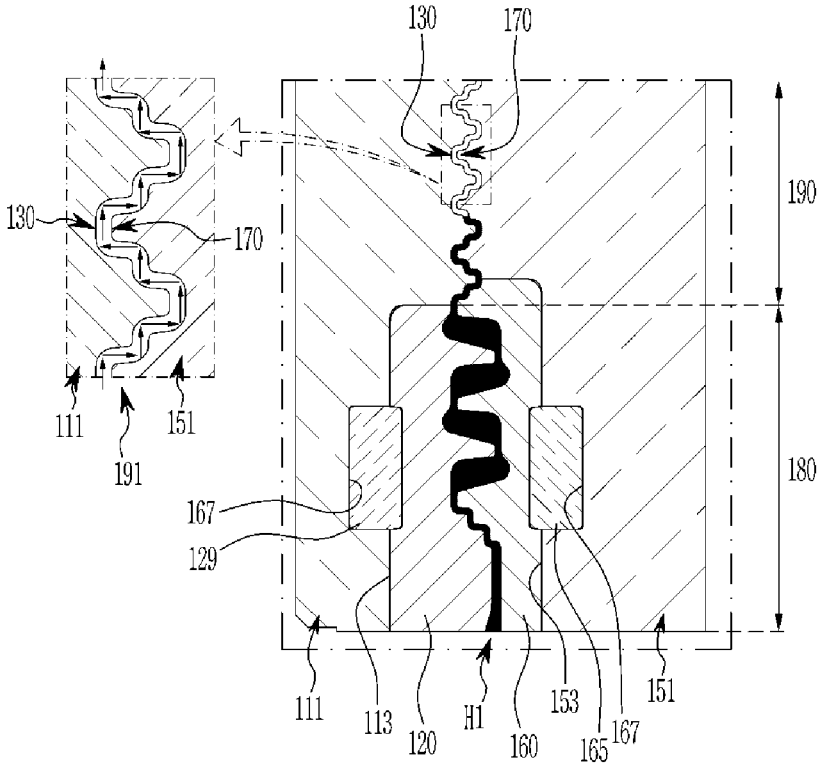

FIGS. 6 to 8 are diagrams illustrating an overall operation of a mold to which a vacuum system for a die casting mold is applied according to an exemplary embodiment of the present disclosure.

Referring to FIG. 6, in the vacuum system for the die casting mold according to the exemplary embodiment of the present disclosure, the molten metal which flows into the cavity 5 through the sleeve 7 is completely filled in the cavity 5 and then continuously flows into the ventilation assembly 100 due to pressing force of the piston 11

Referring to FIG. 7, in the primary flow rate control section 180, a separation flow phenomenon in which a flow path of the molten metal is split into two branches occurs.

For example, some of the molten metal which flows from the entrance 182 of the first flow pattern 181 moves up and flows clockwise in the drawing along one surface 185 and some of the molten metal is discharged to the exit 183. In addition, some molten metal in the vicinity of the exit 183 may flow to the entrance 182 again along the reflective curved surface 187.

By the separation phenomenon, flow energy of the molten metal may be reduced and the flow rate of the molten metal may be reduced.

The first flow pattern may derive the separation phenomenon by the dimension described above.

Referring to FIG. 8, the molten metal passing through the primary flow rate control section 180 enters the secondary flow rate control section 190, and the flow rate of the molten metal is reduced whenever the molten metal passes through a plurality of second flow patterns 191 bent in multiple steps.

In other words, overall energy loss of the molten metal occurs due to turbulent energy formed while the molten metal hits a waveform having a unique pattern in the secondary flow rate control section 190, and a contact area is increased and the flow rate is reduced.

A structure is formed in which the molten metal passing through the primary flow rate control section 180 and the secondary flow rate control section 190 stops after passing through the secondary flow rate control section 190 by a predetermined region, and as a result, it is difficult for the molten metal to enter the vacuum pump 300.

Accordingly, in the vacuum system for the die casting mold according to the exemplary embodiment of the present disclosure, the ventilation assembly 100 is applied so as to prevent the molten metal filled in the cavity 5 from reaching the vacuum pump 300 to simplify the structure and enhance durability.

Moreover, since there is no risk of damage to the vacuum system for the die casting mold, productivity enhancement of a factory may be expected.

Further, the vacuum system for the die casting mold according to the exemplary embodiment of the present disclosure maintains the inside of the cavity 5 in the vacuum state by a simple structure to achieve a thin-wall of an aluminum product and produce a high-quality casting.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

What is claimed is:

1. A vacuum system for a die casting mold forming vacuum inside a cavity formed between a fixed mold and a movable mold, the vacuum system comprising:

a ventilation assembly disposed between the cavity and a vacuum pump and mounted between the fixed mold and the movable mold and configured to decrease a flow rate of molten metal when the molten metal filled in the cavity flows in; and a vacuum pump forming the vacuum inside the ventilation assembly, wherein the ventilation assembly includes: a first body mounted on any one mold between the fixed mold and the movable mold, having a first seating surface formed on a lower inner surface contacting the molten metal, and having an upper guide end protruding stepwise from the first seating surface on an upper inner surface and a plurality of first grooves formed inside the upper guide end to be perpendicular to a flow direction of the molten metal, a first sub-body mounted on the first seating surface, having a lower guide end connected to the upper guide end, and having a plurality of first protrusions formed inside the lower guide end to be perpendicular to the flow direction of the molten metal, a second body mounted on the other mold of the fixed mold and the movable mold, having a second seating surface formed on a lower inner surface contacting the molten metal to correspond to the first seating surface, and having a plurality of second grooves formed to be perpendicular to the flow direction of the molten metal, a second sub-body mounted on the second seating surface and having a plurality of second protrusions formed to be perpendicular to the flow direction of the molten metal, and a cover coupled to tops of the first and second bodies and having a suction port which is in communication with the vacuum pump.

2. The vacuum system of claim 1, wherein the ventilation assembly includes:

a first ventilation unit and a second ventilation unit mounted on the fixed mold and the movable mold, respectively, above the cavity, and the first ventilation unit and the second ventilation unit are in close contact with each other by combining the fixed mold and the movable mold to form a primary flow rate control section on a lower inner surface connected to the cavity and form a secondary flow rate control section connected to the primary flow rate control section on an upper inner surface.

3. The vacuum system of claim 2, wherein in the ventilation assembly, an inlet through which the molten metal moves to the primary flow rate control section in connection with the cavity is formed at one side of a lower end, and an outlet through which air moves in connection with the vacuum pump from the secondary flow rate control section is formed at one side of an upper end.

4. The vacuum system of claim 3, wherein the primary flow rate control section includes:

a first flow pattern having an entrance into which the molten metal flows and an exit from which the molten metal is discharged, and including a chamber causing flow separation of the molten metal formed between the entrance and the exit.

5. The vacuum system of claim 4, wherein:

an angle formed by surfaces facing each other, which are connected to the entrance of the first flow pattern is in a range of 5 to 85°.

6. The vacuum system of claim 4, wherein:

heights of the entrance and the exit of the first flow pattern are in a range of 5 to 15 mm.

7. The vacuum system of claim 4, wherein:

widths of the entrance and the exit of the first flow pattern are in a range of 5 to 15 mm.

8. The vacuum system of claim 4, wherein:

a curvature radius of an edge formed in the first flow pattern is in a range of 0.5 to 5.0 mm.

9. The vacuum system of claim 4, wherein:

a reflective curved surface is formed adjacent to the exit of the first flow pattern, which returns the molten metal toward the entrance of the first flow pattern.

10. The vacuum system of claim 3, wherein the secondary flow rate control section includes:

a second flow pattern having one end connected to the primary flow rate control section, an opposite end connected to the outlet, and having a predetermined shape.

11. The vacuum system of claim 10, wherein in the second flow pattern, a width through which the molten metal passes is in a range of 0.5 to 2 mm.

12. The vacuum system of claim 10, wherein the second flow pattern is symmetric in a multiple-step bending shape and a height between stepped ends is in a range of 1 to 5 mm.

13. The vacuum system of claim 10, wherein in the second flow pattern, the curvature radius of each edge is in a range of 0.5 to 5.0 mm.

14. The vacuum system of claim 1, wherein:

a molten metal groove into which the molten metal flows is formed on the lower guide end of the first sub-body.

15. The vacuum system of claim 1, wherein:

a position of the first sub-body is regulated through a first key between the first sub-body and the first seating surface of the first body, and the position of the second sub-body is regulated through a second key between the second sub-body and the second seating surface of the second body.

16. The vacuum system of claim 1, wherein in the first protrusion and the second protrusion, a first flow pattern having an entrance into which the molten metal flows and an exit from which the molten metal is discharged and including a chamber for causing flow separation of the molten metal formed between the entrance and the exit is formed.

17. The vacuum system of claim 1, wherein the first groove and the second groove form a second flow pattern symmetric in a multi-step bending shape.

* * * * *